United States Patent [19]

Karlak

[11] Patent Number: 4,817,731

[45] Date of Patent: Apr. 4, 1989

[54] RIPPER MECHANISM

[75] Inventor: Daniel L. Karlak, Crystal Lake, Ill.

[73] Assignee: Komatsu Dresser Company, Libertyville, Ill.

[21] Appl. No.: 69,286

[22] Filed: Jul. 1, 1987

[51] Int. Cl.[4] ..... A01B 13/08

[52] U.S. Cl. ..... 172/464; 172/483

[58] Field of Search ..... 172/464, 474, 484, 482, 172/483, 491, 481, 699, 307

[56] References Cited

U.S. PATENT DOCUMENTS

| | | | |
|---|---|---|---|
| 3,433,310 | 3/1969 | Harper | 172/471 |
| 3,503,456 | 3/1970 | Larson | 172/484 |
| 3,527,308 | 9/1970 | Bernota et al. | 172/464 |
| 3,539,018 | 11/1970 | Sprenkel | 172/484 |
| 3,657,831 | 4/1972 | Kant | 37/193 |
| 3,871,462 | 3/1975 | Krolak | 172/483 |
| 3,887,015 | 6/1975 | Kelley | 172/254 |
| 4,003,603 | 1/1977 | Stemler et al. | 299/37 |
| 4,013,129 | 3/1977 | Wilkinson | 172/464 |
| 4,031,964 | 6/1977 | Takahashi et al. | 172/9 |
| 4,174,757 | 11/1979 | Stedman | 172/292 |
| 4,204,578 | 5/1980 | Stedman | 172/307 |
| 4,321,970 | 3/1982 | Thigpen | 172/464 |
| 4,351,397 | 9/1982 | Winker | 172/464 |
| 4,453,600 | 6/1984 | Thigpen | 172/464 |

*Primary Examiner*—Richard J. Johnson

[57] ABSTRACT

An improved parallelogram type ripper mechanism is provided. The mechanism has identical hydraulic pitch and lift cylinders lying in the same vertical plane. Also copolanar with the hydraulic cylinders are fixed length links. Identical left and right hand mounting brackets are attached to the rear of the prime mover.

4 Claims, 2 Drawing Sheets

RIPPER MECHANISM

TECHNICAL FIELD

This invention relates to ripper mechanisms and in particular to ripper mechanisms with identical hydraulic cylinders as well as identical mounting frames.

BACKGROUND ART

Ripper mechanisms are a combination of linkages and hydraulic cylinders arranged in such a manner that when attached to a crawler tractor (or any other prime mover) and finished with a shank, the mechanism rips up earth (or other material) as it is pulled by the crawler tractor. Ripper mechanisms are provided with hydraulic loading cylinders in order to provide lift and pitch for the entire mechanism. Due to the design factors in the typical ripper mechanism, loading cylinders are of different size and length and the mounting frames for the left and right hand sides are of different design.

Due to these different sized parts it is necessary to maintain an inventory of each of the several different sizes. This extra inventory can be very costly. A need thus exists for a ripper mechanism that utilizes identical cylinders for the lift and pitch function and can be attached to identical left and right hand frames.

SUMMARY OF THE INVENTION

A ripper mechanism of the present invention use identical hydraulic cylinders for the lift and pitch functions. The ripper mechanism is also simplified by using the same mounting frame for the left and right hand sides of the mechanism.

BRIEF DESCRIPTION OF THE DRAWINGS

For a more complete understanding of the present invention and for further advantages thereof, reference is now made to the following Description of the Preferred Embodiment taken in conjunction with the accompanying drawings in which.

DESCRIPTION OF THE PREFERRED EMBODIMENTS

Figure 1:
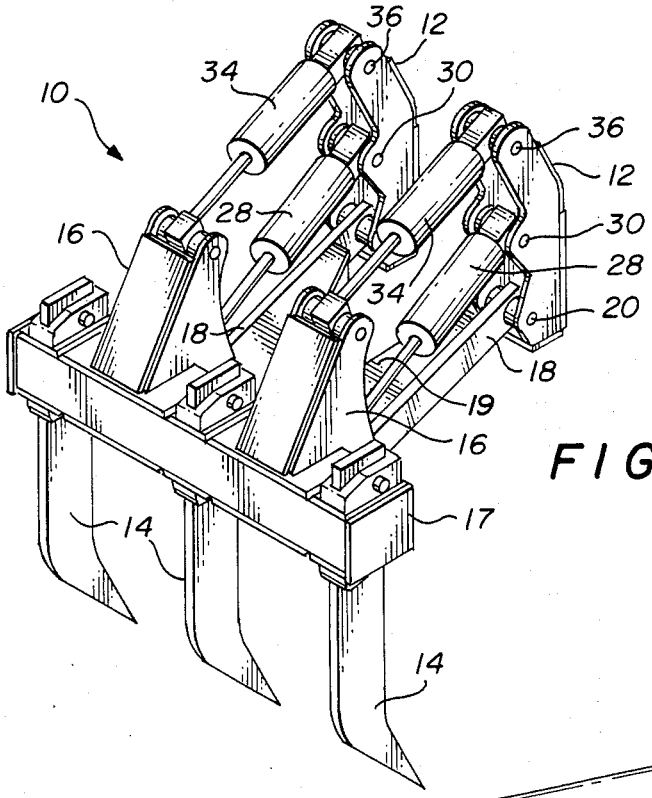
FIG. 1 is a side perspective view of the present invention.
Figure 2:
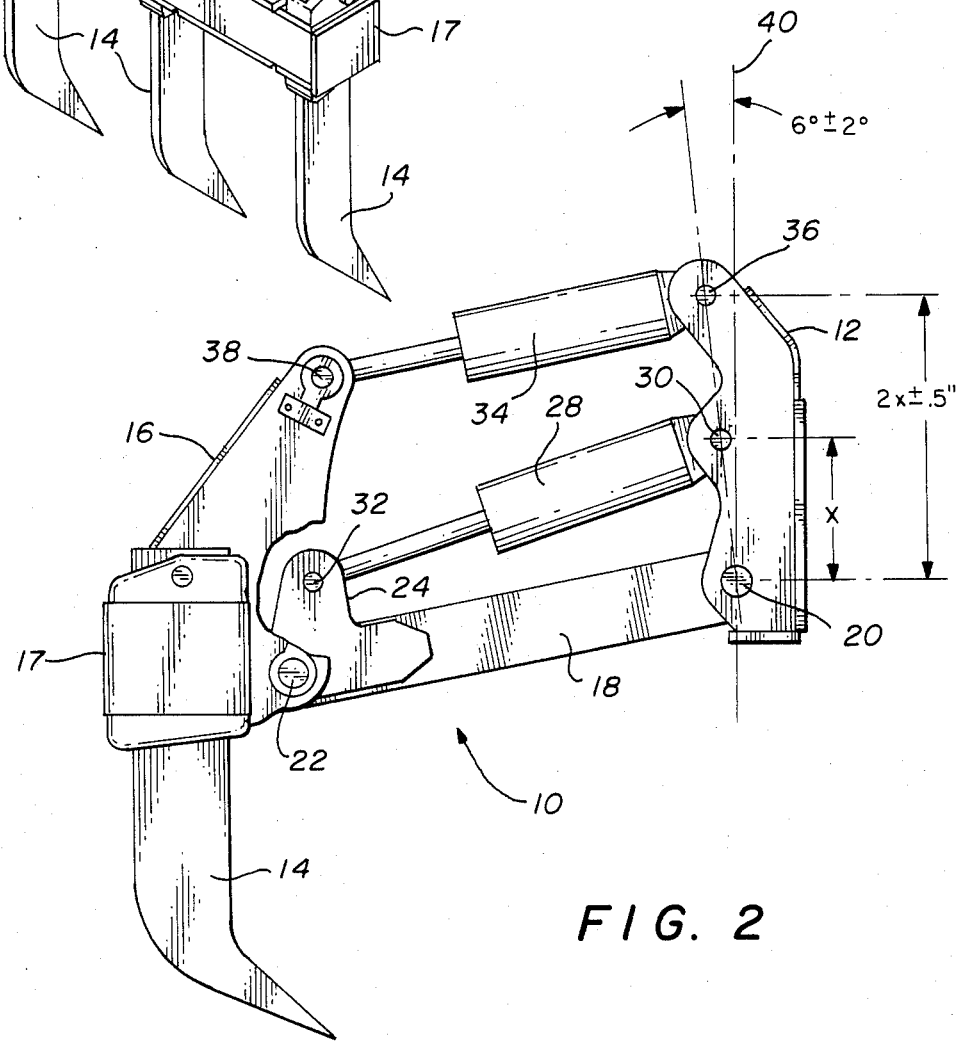
FIG. 2 is a side view of the present invention.
Figure 3:
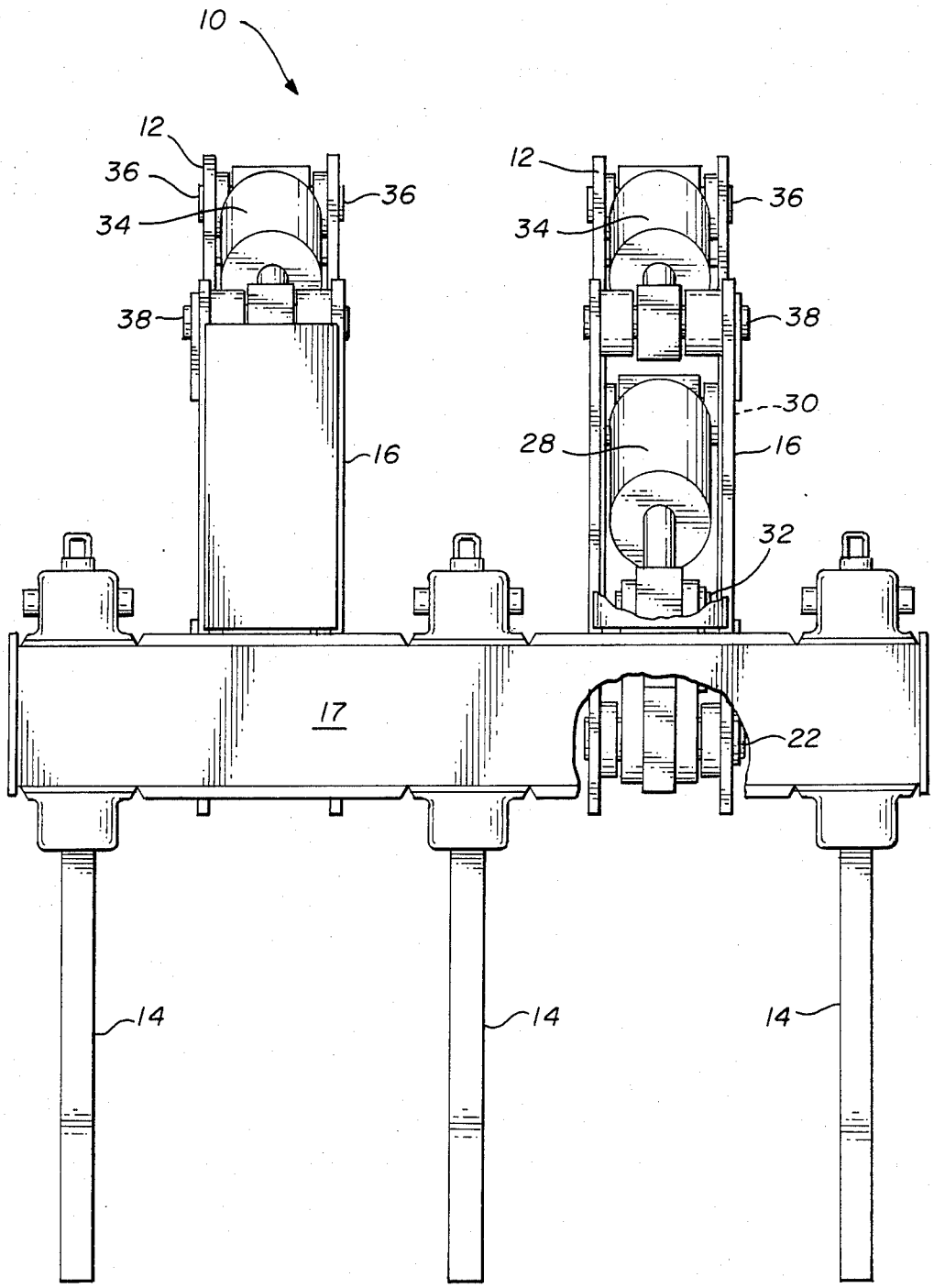
FIG. 3 is a front view of the present invention.

Referring, simultaneously, to FIGS. 1, 2 and 3, a ripper mechanism of the present invention is generally identified by reference numeral 10. A pair of identical left and right hand mounting brackets 12 are fixedly secured to the rear of a primer mover (not shown). At least one ripper shank 14 is fixedly attached to a toolbeam 17.

A draft beam 18, which is a pair of parallel links lying in the same horizontal plane and fixedly attached to each other by crosspiece 19 is pivotally attached at pivot point 20 to the mounting brackets 12 and pivotally attached at 22 to the toolbeam towers 16. Draftbeam 18 has a lifting brace structure 24 fixedly attached distal from the mounting brackets 12. Brace structures 24 are substantially triangular shaped with a pivot point 32. Brace structure 24 and pivot point 32 extend some specified distance above draftbeam 18.

A pair of identical parallel hydraulic lift cylinders 28, lying in the same horizontal plane are pivotally attached at pivot point 30 to the mounting brackets 12 and pivotally attached at pivot point 32 to the brace structure 24.

Lift cylinders 28 are attached to mounting brackets 12 at a specified distance X above the point of attachment of links 18 to mounting brackets 12

A pair of identical parallel hydraulic pitch cylinders 34 lying in the same horizontal plane are pivotally attached at pivot point 36 to the mounting brackets 12 and pivotally attached at pivot point 38 to the toolbeam towers 16. Pitch cylinders 34 are attached to mounting brackets 12 at a specified distance $2\times\pm0.5$ inches above the point of attachment of draftbeam 18 to mounting brackets 12.

Hydraulic lift cylinders 28 are identical to hydraulic pitch cylinders 34. Hydraulic lift cylinders 28, hydraulic pitch cylinders 34 and draftbeam links 18 are in the same vertical plane.

Lift cylinders 28 and pitch cylinders 34 are attached to mounting brackets 12 at an angle of $6°\pm2°$ toward toolbeam towers 16 from a vertical axis 40 passing through the center of pivot point 20.

Although the present invention has been described with respect to a specific preferred embodiment thereof, various changes and modifications may be suggested to one skilled in the art and it is intended that the present invention encompass such changes and modifications as fall within the scope of the appended claims.

I claim:

1. An improved parallelogram type ripper mechanism for attachment to a prime mover comprising:

a pair of identical left and right hand mounting brackets fixedly secured to the rear of the prime mover;

a toolbeam having a pair of toolbeam towers;

at least one ripper shank fixedly attached to said toolbeam;

a draft frame including a pair of identical parallel left and right hand links, each having a first and second end lying in the same plane relative to each other and each of said links being pivotally attached at said first end to one of said toolbeam towers and pivotally attached to one of said mounting brackets at said second end;

said links each having a lifting brace structure fixedly attached to said second ends;

a pair of identical parallel left and right hand hydraulic lift cylinders lying in the same plane relative to each other, each having first and second end, and each being pivotally attached on said first end to said mounting brackets and pivotally attached to said lifting brace structures on said second end;

a pair of identical parallel left and right hand hydraulic pitch cylinders said pitch cylinders being identical to said lift cylinders lying in the same plane relative to each other, each having a first and second end, and each being pivotally attached on said first end to said toolbeam towers and pivotally attached to said mounting brackets at said second end;

said left and right hand lift cylinders being mounted to said mounting brackets in the same vertical plane as said left and right hand links, respectively, and said first ends thereof being vertically disposed a specified distance from the point of attachment between said link and said mounting bracket;

said left and right hand pitch cylinders being mounted to said mounting brackets in the same vertical plane as said left and right hand links, respectively, and said first ends thereof being vertically disposed a distance of approximately twice said specified distance from the point of attachment between said link and said mounting bracket; and said lift and pitch cylinders being attached to said mounting brackets at vertically spaced locations along a line positioned at a predetermined angle rearwardly toward said toolbeam towers from a vertical axis passing through the center of the attachment point of each said link to said mounting brackets.

2. The improved parallelogram type ripper of claim 1, wherein said predetermined angle is approximately 6°.

3. The improved parallelogram of claim 1, wherein said lifting brace structure comprises a portion generally perpendicular to and extending above said link.

4. An improved parallelogram type ripper mechanism for attachment to a prime mover comprising:

a pair of identical left and right hand mounting brackets fixedly secured to the rear of the prime mover;

a toolbeam having a pair of toolbeam towers;

at least one ripper shank fixedly attached to said toolbeam;

a draftframe including a pair of identical parallel left and right hand links, each having first and second end, lying in the same horizontal plane relative to each other and each of said links being pivotally attached on said first end to said toolbeam towers and pivotally attached to said mounting brackets at said second end;

said links each having a lifting brace structure fixedly attached to said second ends;

said lifting brace structure having a portion generally perpendicular to and extending above said link;

a pair of identical parallel left and right hand hydraulic lift cylinders lying in the same horizontal plane relative to each other, each having a first and second end, and each being pivotally attached on said first end to said mounting brackets and pivotally attached to said lifting brace structures on said second end;

a pair of identical parallel left and right hand hydraulic pitch cylinders lying in the same horizontal plane relative to each other, each having a first and second end, and each being pivotally attached on said first end to said toolbeam towers and pivotally attached to said mounting brackets at said second end;

said lift cylinders being identical to said pitch cylinders;

said left and right hand lift cylinders being mounted to said mounting brackets in the same vertical plane as said left and right hand links, respectively, and said first ends thereof being vertically disposed a specified distance from the point of attachment between said link and said mounting bracket;

said left and right hand pitch cylinders being mounted to said mounting brackets in the same vertical plane as said left and right hand links, respectively, and said first ends thereof being vertically disposed a distance of approximately twice said specified distance from the point of attachment between said link and said mounting bracket; and said lift and pitch cylinders being attached to said mounting brackets at an angle toward said toolbeam towers of approximately 6° from a vertical axis passing through the center of the attachment point of each said link to said mounting brackets.

* * * * *

UNITED STATES PATENT AND TRADEMARK OFFICE

CERTIFICATE OF CORRECTION

PATENT NO. : 4,817,731

DATED : April 4, 1989

INVENTOR(S) : Karlak

It is certified that error appears in the above-identified patent and that said Letters Patent is hereby corrected as shown below:

Column 1, line 29, "use" should read --uses--;

Column 2, line 34, "draft frame" should read --draftframe--;
line 45, after "having", insert --a--;

Column 3, line 24, after "having", insert --a--;
line 25, delete "horizontal";

Column 4, line 2, delete "horizontal"; and
line 9, delete "horizontal".

Signed and Sealed this

Fourteenth Day of November, 1989

*Attest:*

JEFFREY M. SAMUELS

*Attesting Officer* *Acting Commissioner of Patents and Trademarks*